United States Patent [19]

Schwinn

[11] Patent Number: 4,854,733

[45] Date of Patent: Aug. 8, 1989

[54] PORTABLE PACKING BAG HAVING A TWO SECTION LOOP HANDLE

[75] Inventor: Georg Schwinn, Gronau, Fed. Rep. of Germany

[73] Assignee: M u. W Verpackungen, Gronau, Fed. Rep. of Germany

[21] Appl. No.: 930,360

[22] Filed: Nov. 12, 1986

[30] Foreign Application Priority Data

Aug. 2, 1986 [DE] Fed. Rep. of Germany ..... 3626303
Aug. 30, 1986 [DE] Fed. Rep. of Germany ..... 3629563

[51] Int. Cl.[4] ..... B65D 33/10

[52] U.S. Cl. ..... 383/29; 229/52 AL; 383/12; 383/15; 383/25

[58] Field of Search ..... 383/63, 65, 28, 29, 383/6, 8, 10, 25, 120, 12, 24, 30, 15; 229/52 AL

[56] References Cited

U.S. PATENT DOCUMENTS

| | | | |
|---|---|---|---|
| 1,691,905 | 11/1928 | Gamble | 383/29 X |
| 2,865,420 | 12/1958 | Allenbach | 383/24 |
| 3,282,493 | 11/1966 | Kamins et al. | 383/63 X |
| 3,370,630 | 2/1968 | Haugh et al. | 383/120 X |
| 3,502,258 | 3/1970 | Kugler et al. | 383/99 X |
| 3,580,486 | 5/1971 | Kugler | 383/8 |
| 3,877,352 | 4/1975 | Brieske | 383/6 X |
| 4,252,269 | 2/1981 | Peppiatt | 383/10 X |
| 4,353,196 | 10/1982 | Beer et al. | 383/8 X |
| 4,573,203 | 2/1986 | Peppiatt | 383/29 |
| 4,721,398 | 1/1988 | Sengewald | 383/8 |

FOREIGN PATENT DOCUMENTS

| | | | |
|---|---|---|---|
| 1022595 | 3/1966 | United Kingdom | 383/28 |
| 1599645 | 10/1981 | United Kingdom | 383/28 |

*Primary Examiner*—Bryon P. Gehman
*Attorney, Agent, or Firm*—Felfe & Lynch

[57] ABSTRACT

A portable packing bag made of plastic film for carrying flexible and/or folded products includes rectangular front and rear side panel sections which are (a) joined, one to the other, at their vertical edges to provide lateral side panel sections, (b) joined at their upper edges to provide a top cover section, and (c) initially unconnected at their lower edges to permit the bag to be filled but are thereafter joined at such edges, after filling, to form a completely closed bag. The cover section or gusset has upstanding edges that define a shallow trough at the top of the bag. The bag further includes a handle formed as a U-shaped loop which includes across the cover section and is attached to the opposite inner sides of the upstanding edges of the trough. The handle itself is formed of a pair of substantially equal sections which are joined, to form the U-shaped loop, along a seam at the apex of the loop.

13 Claims, 5 Drawing Sheets

PORTABLE PACKING BAG HAVING A TWO SECTION LOOP HANDLE

BACKGROUND OF THE INVENTION

The present invention relates to a portable packing bag made of plastic film and usable especially for containing flexible and/or folded products, such as disposable diapers.

The present invention further relates to a method of producing a portable packing bag of this type.

The U.S. Pat. No. 4,573,203 discloses a carrying bag made of thermoplastic material which includes generally rectangular front and rear panels, a gusset disposed between the panels and formed integrally therewith, and a handle joined to one end, with the other (opposite) end of the bag being open to facilitate the introduction of goods into the bag. The filled bag assumes approximately the shape of a hexahedron. The handle is formed as a loop and each end thereof is provided with a strip having a length corresponding to the width of the aforementioned panels. Each strip is joined to the exterior of one of the panels adjacent to the respective outer boundary of the gusset.

In this known carrying bag, the exteriorly joined, shaped parts made of plastic film and defining the handle each overlap the upper edge of the bag with a width of some centimeters on the outer sides of the front and rear panels. Approximately midway (of the width) of these overlaps, there is provided a seam joining the handle strips to the bag proper. In this manner, there is formed below this seam an approximately 2 cm wide ruche-like projecting edge which loosely contacts the upper region of front and rear panels and which extends downward with respect to the handle.

This packing bag has the disadvantage that the exterior seam, and the material strip fixed by the seam, limit the height of the area on the outer side of the bag which is available for printing. Additionally, dirt particles may become trapped in the gaps above and below the weld seam between the exterior strips and the underlying outer side of the bag during transport and stacking, thereby affecting the aesthetic appearance of the packing bag. Further, when such a packing bag is removed from a stack, the loose, projecting edges may become erect, thereby posing undesirable resistance to removal which might even result in tearing off of the handle. A still further disadvantage of this packing bag is the limited width of its handle, which may not be greater than the width of its bottom end which is attached to the bag proper.

It is therefore the object of the present invention to provide a portable packing (or carrying) bag which is further developed and improved over the conventional bag of the type just described, in that bag material does not project outwardly on the outer sides of the bag in the region between the bag body and its attached handle. It is a further object of the present invention to overcome and eliminate the above-indicated drawbacks or imperfections of prior known packing (or carrying) bags.

SUMMARY OF THE INVENTION

In a portable packing bag made of plastic film of the type described above, these objects are achieved, according to the present invention, by attaching the handle ends to the opposite inner sides of the upstanding edges of a trough defined by the top cover section of the bag.

The expressions "upper", "lower", "vertical", "head region", "top", "cover", "side", "bottom" and the like, as used in the following specification and in the claims, relate to a filled bag placed in the carrying position with the handle at the top.

Owing to the fact that the handle ends are no longer sealed to the outer sides of the side panel sections defining the bag, but rather to the trough formed by the top cover section, there is obtained, to great advantage and in a surprising manner, a transition between these sections without any projecting edges or strips of material. Accordingly, the full height of the front and rear panel sections, respectively, of the bag may be utilized for printing. Furthermore, dirt particles cannot settle in the region which is visible from the exterior. Still further, the bag can be removed from a stack in every direction and without any resistance or tearing.

In this connection, reference may be made to the carrying bag disclosed in the U.S. Pat. No. 4,252,269 in which a handle loop is welded directly to a gusset formed in the top cover portion. The present invention departs from this conventional construction. This construction according to U.S. Pat. No. 4,252,269, presents the drawbacks that the bag is not re-usable after the opening and removal of the filling goods and that the joint between the handle and the bag proper proves to be extremely weak. In this case, if weight of the filling goods is too great, the handle is sometimes torn off at one or both of its ends. Still another drawback of this conventional carrying bag is that the bag, although adapted to be stacked while lying on one of its side surfaces, cannot be grasped without some difficulty when the customer has only one hand free. The handle opening is relatively small so that grasping requires a certain degree of accuracy. Furthermore, with the handle being in a horizontal position, the handle opening is positioned unfavorably with the result that it is not possible, in passing by, to positively grasp a filled carrying bag and to take it away or withdraw it from the stack in one stroke.

A preferred method of producing the portable packing bag, exhibiting the features of the invention, comprises the following sequence of method seps:

- placing on a worktable a continuous film web with the intended outer surface of the packing bag directed upwards;
- applying a pair of handle strips to this film web in parallel with, and equally spaced from the center line (y—y) of the film web, preferably in the form of separate film web strips;
- producing parallel seams between the handle strips and the film web along the edges of the handle strips that are closest to the center line;
- folding the film web into the shape of a semi-tube with exteriorly positioned handle strips while forming a half-loop between the handle strips;
- folding back inward upon itself the center portion of the film web between the handle strips to define a folded top cover section and side panel sections by means of an inner fold having an inner crease line and a pair of outer crease lines, whereby the seams of the handle strips come to lie on the inner sides of the fold in the vicinity of the upper folded edges in a closely spaced and parallel relation adjacent to the outer crease lines, such that the handle strips are disposed approximately in the plane of the side panel sections;

producing seams on the vertical edges of the side panel sections to join the latter into a tubular shape;

joining the handle strips together at their outer edges, optionally die cutting handle apertures and notches or cutouts to define lateral contours on the handle strips; and cutting to length the film web with the handle strips to form discrete bag sections of a length suitable for each complete bag.

By making the handle from two joined handle strips, the handle itself may have any width at either its top or its bottom.

According to an advantageous embodiment of the method, the first three method steps are performed continuously and largely in timed overlapping relationship.

Preferably, double-layer film material is used for the principal portions (panels) of the bag, with the outer side having, as the outer film, a thin-layer plastic film that is particularly suitable for applying color printing, and the inner side having a plastic with excellent welding (heat sealing) and strength characteristics.

The invention is shown in accompanying drawings illustrating a preferred embodiment, with the drawings also showing further beneficial details of the invention and, particularly, the production method according to the invention.

DETAILED DESCRIPTION OF THE PREFERRED EMBODIMENT

Figure 1:
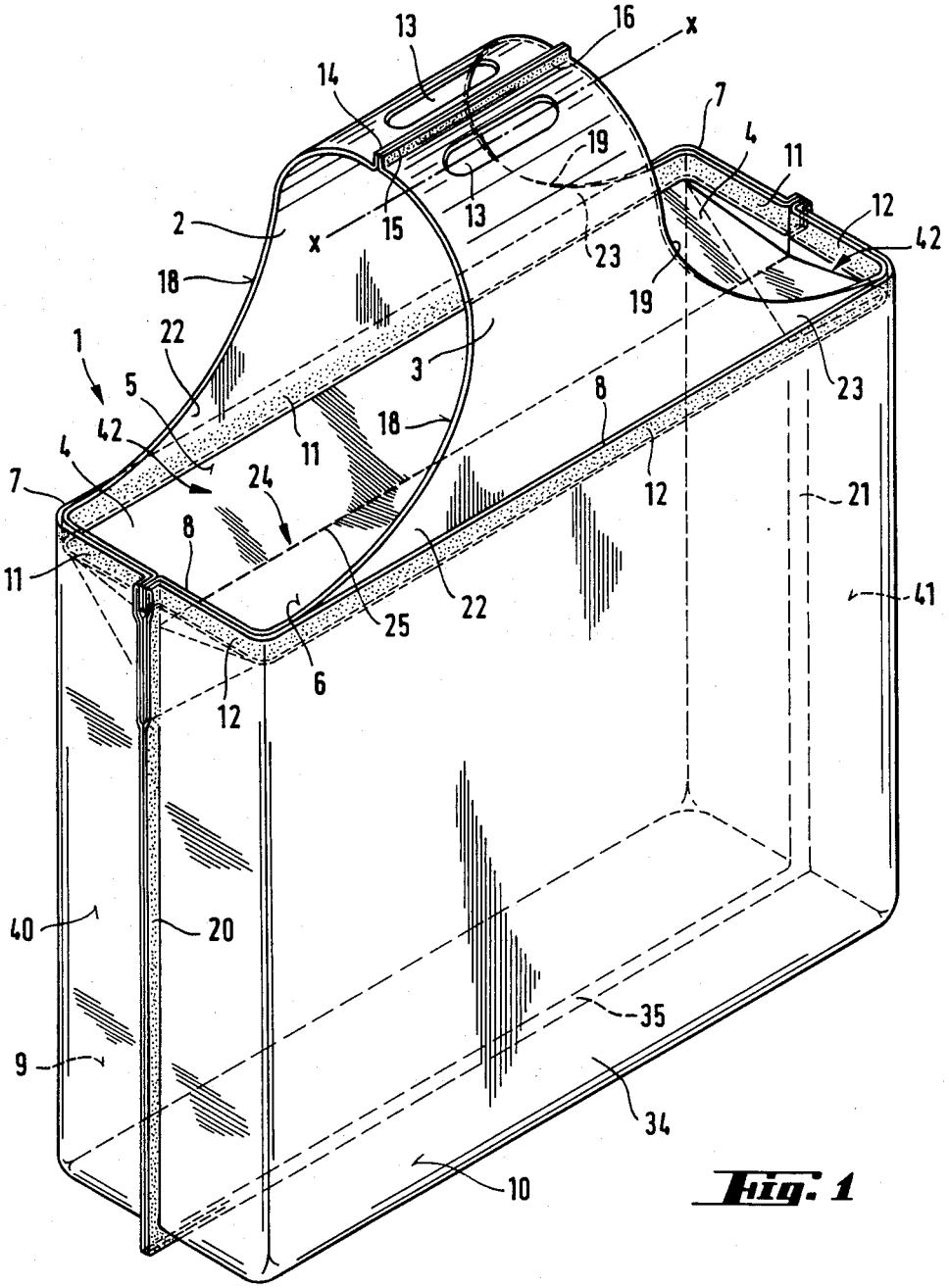
FIG. 1 is a perspective view of the portable packing bag according to a preferred embodiment of the present invention.

The preferred embodiment of the present invention will now be described with reference to FIGS. 1–7 of the drawings. Identical elements in the various figures are designated with the same reference numerals.

A portable filled packing (or carrying) bag 1 made of double-layer plastic film is shown in FIG. 1. In its filled state, the bag 1 has approximately a hexahedron shape. This bag may also assume a more or less distinct pillow shape by bulges, rounded edges and the like, which latter shape is defined substantially by the contents of the bag. The bag 1 comprises rectangular rear and front side panel sections 9 and 10, respectively, which are joined by lateral side panel sections 40, 41. Vertical seams 20, 21, formed by heat sealing or similar conventional bonding methods, extend across the side sections 40, 41, respectively, and provide a tubular shape. The side panel sections 9, 10, 40, 41 are also integrally joined to each other at their upper edges by a folded or gusset top cover section 4. The lower end 34 of the bag is initially left open. This end is closed in a conventional manner, after the bag is machine filled, by a transversely extending bonded or heat sealed seam 35.

The folded top cover section 4 is provided with upstanding edges 7, 8 that define a shallow trough or recess 42. The depth of this trough is only a small proportion of the overall height of the packing bag.

Extending across the folded top cover section 4 is a handle made of two half-sections 2, 3 and formed as a U-shaped loop. The two sides 2 and 3 of this handle are attached in the head region of the bag 1 along the upper upstanding edges 8 of the panel sections 9, 10 to opposite sides thereof, i.e. to the upstanding edges of the trough 42, defined by the top cover section 4. Each of the two side panel sections 9 and 10, respectively, therefore has on its carrying end one internally attached handle side 2, 3 joined at a seam 11, 12 and provided with a handle aperture 13.

The upper edges 14, 15 of the two handle sides 2, 3, respectively, are joined to each other along a heat sealed seam 16 that extends in parallel with the axis x—x of a handle aperture 13; i.e., at the apex of the U-shape. The lower edges of the handle sides 2, 3 are joined by means of heat sealed seams 11, 12, respectively, to the top cover section 4,—and, more particularly, to the inner sides 5, 6 thereof—in the vicinity of the upper edges 8 which are each defined between a side panel section 9, 10 and the inwardly folded cover section 4. Accordingly, the handle does not contact the outer surfaces of the side panel sections 9 or 10, but rather contacts the upper, inner region of the folded cover section 4 within the trough 41. In this way, there is provided a smooth transition from the panel sections 9, 10 to the handle sides 2, 3, respectively, without any projecting material ends in the region of the upstanding edges 8.

Figure 7:
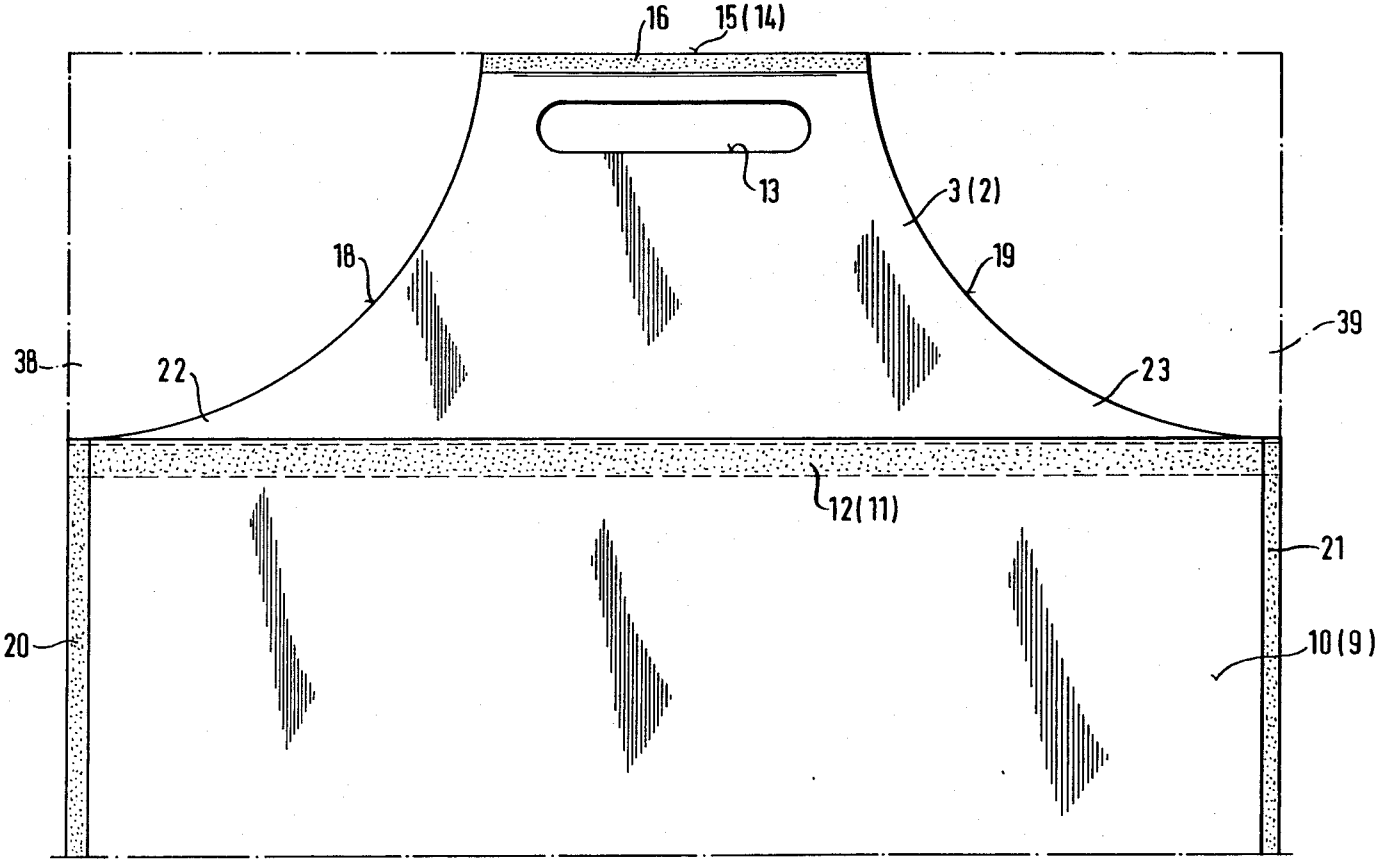
FIG. 7 is a partial plan view of the front side of the bag illustrating the final state of a still further method step for producing the bag wherein handle apertures and arcuate notches of the side or lateral contours of the handle strips are die cut.

Further and advantageously, as is illustrated in FIG. 7, the portions 38, 39 of each handle part 2, 3 which project outwards from the handle aperture 13 on either side, are each shaped with a preferably arcuate notch or cutout to form narrow tabs 22, 23, in the vicinity of the upper edges of the respective side panel sections 9, 10.

Still further, in the embodiment illustrated in FIG. 1, the top cover section 4 is provided with a weakening line 25 which permits the section 4 to be easily torn open. This line 25 may extend along a central inner fold 24 and/or along other parts of the section 4. Advantageously, the weakening line 25 is formed by perforations.

The plastic film web to be used for the front side panel section 10, the top cover section 4 and the rear side panel section 9 is preferably formed from a double-layer laminated film comprising (1) a thin film layer as the outer layer which is particularly suitable for applying color printing, and (2) a film layer of a second material, such as polyethylene, as the supporting inner layer which has relatively good welding (heat sealing) and strength characteristics. This use of such conventional multi-layer laminated films advantageously permits the selection of different materials each having specific characteristics or properties especially suited for the respective purpose or use. The outer film layer may be opaque and provided, for example, with printing on its outer surface. The inner layer may be transparent or translucent, and it may have a higher strength than the outer layer of the laminated film.

Finally, the handle parts 2, 3 may be formed of a clear, single-layer plastic film of relatively high tensile strength.

FIGS. 2 to 7 illustrate in detail the various steps of the method of producing the packing bag according to the present invention.

Figure 2:
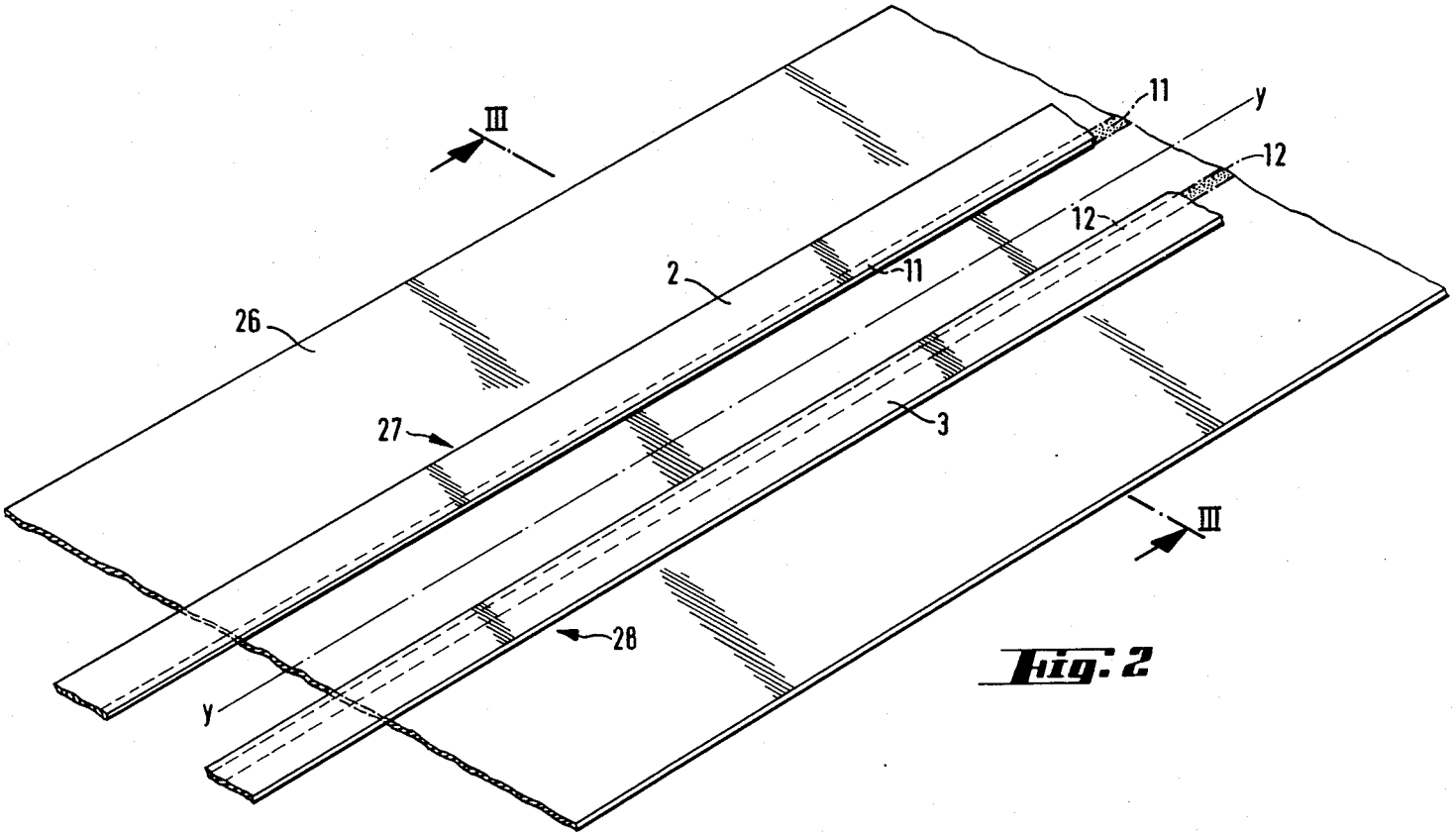
FIG. 2 is a perspective view illustrating a first method step for producing the bag shown in FIG. 1 from a relatively wide endless film web and two handle strip webs fed from separate, likewise endless, film webs.
Figure 3:
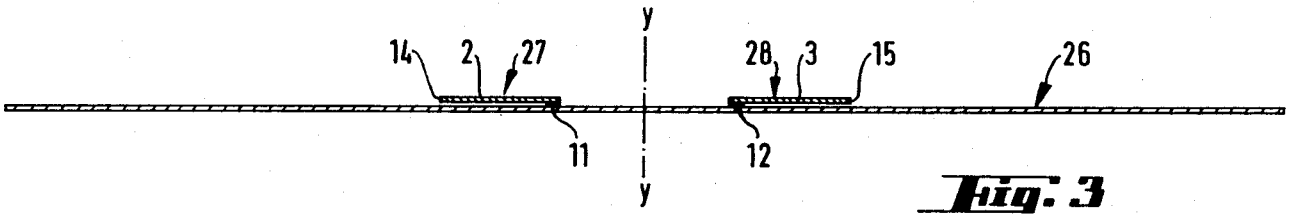
FIG. 3 is a sectional view of the main film web and handle strips shown in FIG. 1.

As shown in FIGS. 2 and 3, an "endless" film web 26 is first unreeled from a supply roll and drawn across a machine worktable. Simultaneously, a pair of handle strips 2, 3, preferably likewise in the form of separate endless film webs 27, 28, are extended in parallel with, and applied to the film web 26 spaced slightly away and at equal distances from the center line y—y. Simultaneously with these initial method steps, parallel weld seams 11 and 12 are continuously formed by heat sealing.

FIG. 3 illustrates the position and placement of the film web 26 and of the handle strips 2, 3 as well as the joining weld seams 11 and 12, as seen from the narrow side or in section, respectively.

Figure 4:
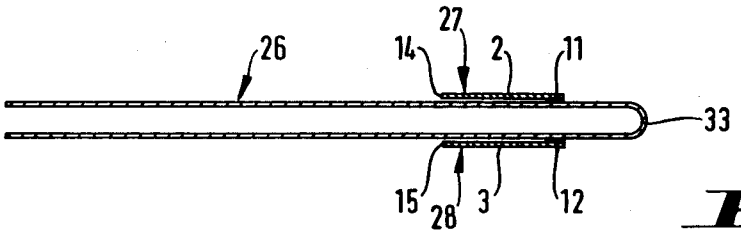
FIG. 4 is a sectional view illustrating a second method step for producing the bag wherein the film web is folded into the shape of a semi-tube.
Figure 5:
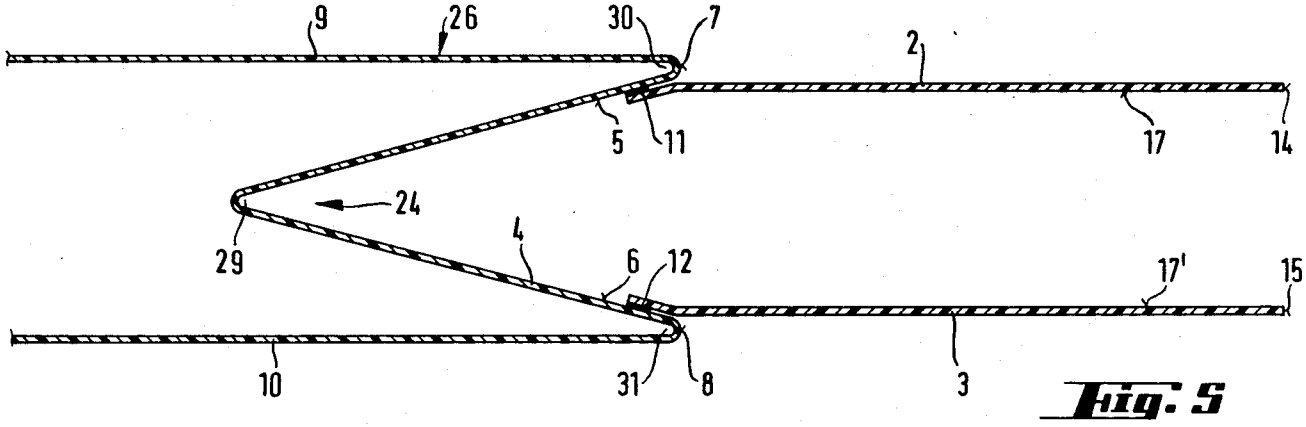
FIG. 5 is a sectional view illustrating a further method step of producing the bag wherein the center section is folded back into the semi-tube.
Figure 6:
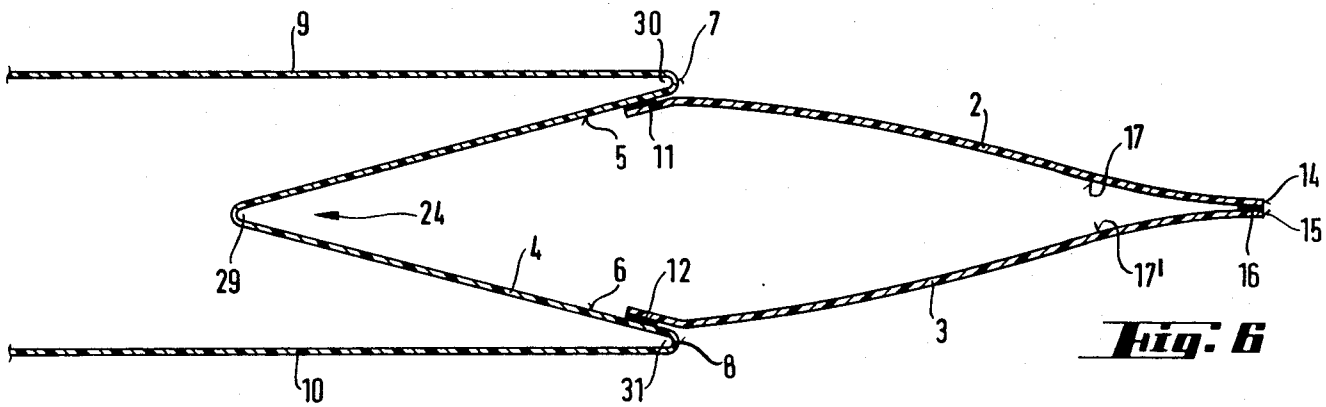
FIG. 6 is a sectional view illustrating a still further method step of producing the bag wherein the two handle strips are welded (heat sealed) together.

Next, in a further step the film web 26 is folded into the shape of a semi-tube (a tube with one open side) with the handle strips disposed on the outer side thereof, as shown in FIG. 4. Thereafter, in another continuous or discontinuous mechanical method step, the center portion 33 between the side panel sections 9 and 10 is folded back inwards upon itself, thereby forming the folded top cover section 4 between the handle strips 2, 3. Thus, as shown in FIG. 5, a distinct inner fold 24 is formed having an inner crease line 29 and a pair of outer crease lines 30 and 31. In this way, the seams 11, 12 of the handle strips 2, 3 are folded against the inner sides 5, 6 of the fold 24 in the vicinity of the upper outer crease lines 30, 31 in a closely spaced parallel relation thereto. The handle strips 2, 3 in their interior disposition on the folded cover section 4 thus assume a position in a plane approximately in parallel with the two side panel sections 9, 10.

In a further method step, vertical weld seams 20, 21 are produced, forming the side or lateral sections 40, 41, of the bag, whereby the superimposed portions of the film are joined to define a tubular shape.

In a subsequent method step, the two handle strips 2, 3 are joined or bonded at their outer edges by a heat sealed seam 16. Simultaneously or subsequently, the handle aperture 13 and the arcuate notches or cutouts 38, 39 which define the lateral contours 18, 19 are die cut from the handle strips 2, 3, thereby to form the handle.

Thereafter, individual sections, each having a length required for a complete bag 1, are cut off from the endless film web 26 with the handle strips 2, 3 welded (heat sealed) thereto. The bags are then filled, upon inflation thereof, in a manner well known in the art. Finally, the bottom part 34 of the bag is closed by means of a transversely extending, heat sealed seam 35.

The above-described sequence of method steps in a highly advantageous manner lends itself to the largely continuous and on-line production of the packing bags 1 having the configuration according to the invention. The bags may be manufactured at relatively low cost on conventional production equipment or machines.

There has thus been shown and described a novel portable packing bag and method of making the same which fulfill all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention which is limited only by the claims which follow.

What is claimed is:

1. In a portable packing bag made of plastic film for carrying flexible and/or folded products, said bag comprising approximately rectangular front and rear side panel sections which are joined, one to the other, at their vertical edges to provide lateral side panel sections, (b) joined at their upper edges to provide a top cover section, and (c) initially unconnected at their lower edges to permit said bag to be filled but are thereafter joined at such edges, after filling, to form a completely closed bag, said cover section having upstanding edges that define a shallow trough at the top of said bag, said bag further comprising a handle formed as a U-shaped loop which extends across said cover section and is attached at its opposite ends at said side panel sections, the improvement wherein said handle comprises a pair of substantially equally dimensioned, discrete sections which are joined to form said U-shaped loop along a seam at the apex of said loop, wherein said opposite ends of said handle are attached to the opposite inner sides of said upstanding edges of said trough and wherein said handle is made of sealable plastic, flexible, sheet material.

2. The packing bag defined in claim 1, wherein said front and rear side panel sections are integrally joined at their upper edges, whereby said cover section is made of the same material as said front and rear side panel sections.

3. The packing bag defined in claim 1, wherein said front and rear side panel sections extend integrally into said lateral side panel sections and are joined together by vertical seams in said side panel sections.

4. The packing bag defined in claim 3, wherein said vertical seams extend substantially through the centers of said side panel sections.

5. The packing bag defined in claim 1, wherein said handle sections have matching handle apertures therein in a position below their joining seam, thereby to permit said handle to be grasped by fingers extending through said apertures.

6. The packing bag defined in claim 5, wherein said handle sections terminate at their handle ends in narrow, laterally extending tabs which are attached to said upstanding edges of said trough.

7. The packing bag defined in claim 6, wherein the lateral edges of said handle section, between said apex and said ends, form an arcuate notch, whereby said handle is narrower at said apex of said loop than at said handle ends.

8. The packing bag defined in claim 1, wherein said top cover section includes a weakening line adapted to be torn open by the user of the bag.

9. The packing bag defined in claim 1, wherein said weakening line is formed by perforations in said cover section.

10. The packing bag defined in claim 1, wherein said weakening line extends along a central inner fold or crease of said cover section.

11. The packing bag defined in claim 1, wherein said front and rear panel sections, said side panel sections and said top cover section are formed from a double layer, laminated film.

12. The packing bag according to claim 11, wherein said laminated film is made of plastic.

13. The packing bag defined in claim 1, wherein said handle of said bag is formed of a clear plastic film of relatively high tensile strength.

* * * * *